US009764362B2

(12) United States Patent
Mou et al.

(10) Patent No.: US 9,764,362 B2
(45) Date of Patent: Sep. 19, 2017

(54) AIR-PRESSURE-TYPE DUAL-BIN AIR-POWERED SEPARATOR

(71) Applicants: HONGTA TOBACCO (GROUP) CO., LTD., Yuxi (CN); YUXI JIXINGDEYI TRADE & INDUSTRY CO., LTD., Yuxi (CN)

(72) Inventors: Dingrong Mou, Yuxi (CN); Yi Wang, Yuxi (CN); Quan Zou, Yuxi (CN); Yunchuan Zhao, Yuxi (CN); Ran Chen, Yuxi (CN); Guangtao Yang, Yuxi (CN); Xiaohua Gao, Yuxi (CN); Yuan Cai, Yuxi (CN); Wenhui Qi, Yuxi (CN); Xiaohui Qiao, Yuxi (CN); Wenpin Xiao, Yuxi (CN); Yuanchun Dou, Yuxi (CN); Hao Fan, Yuxi (CN); Binghai Qian, Yuxi (CN)

(73) Assignees: HONGTA TOBACCO (GROUP) CO., LTD., Yuxi (CN); YUXI JIXINGDEYI TRADE & INDUSTRY CO., LTD., Yuxi (CN)

( * ) Notice: Subject to any disclaimer, the term of this patent is extended or adjusted under 35 U.S.C. 154(b) by 66 days.

(21) Appl. No.: 14/902,558

(22) PCT Filed: Apr. 29, 2014

(86) PCT No.: PCT/CN2014/076529
§ 371 (c)(1),
(2) Date: Dec. 31, 2015

(87) PCT Pub. No.: WO2014/135130
PCT Pub. Date: Sep. 12, 2014

(65) Prior Publication Data
US 2016/0375467 A1 Dec. 29, 2016

(51) Int. Cl.
*B07B 7/00* (2006.01)
*B07B 11/06* (2006.01)
(Continued)

(52) U.S. Cl.
CPC ..... *B07B 11/06* (2013.01); *B07B 7/01* (2013.01); *B07B 7/08* (2013.01); *B07B 9/00* (2013.01); *B07B 11/00* (2013.01)

(58) Field of Classification Search
CPC .. B07B 4/00; B07B 4/02; B07B 4/025; B07B 7/00; B07B 7/08; B07B 9/00; B07B 9/02; B07B 11/00
(Continued)

(56) References Cited

U.S. PATENT DOCUMENTS 8,905,681 B2 * 12/2014 Schneider ..... B65G 53/06 209/139.1
2012/0248012 A1 * 10/2012 Ungerechts ..... B07B 4/025 209/137
2014/0339139 A1 * 11/2014 Schneider ..... B65G 69/182 209/133

FOREIGN PATENT DOCUMENTS

CN 2791087 Y 6/2006
CN 2848375 Y 12/2006
(Continued)

*Primary Examiner* — Joseph C Rodriguez
*Assistant Examiner* — Kalyanavenkateshware Kumar
(74) *Attorney, Agent, or Firm* — Gokalp Bayramoglu

(57) ABSTRACT

The present invention comprises: a separation silo, a discharge silo, a upper sidewall of the separation silo communicated with the discharge silo through a communication port, wherein an air curtain is disposed in the communication port to isolate the silos from each other, a discharge port is disposed at the bottom of the discharge silo, a suction outlet is mounted on the top of the separation silo, a feeding port is disposed at the lower part of a sidewall of the separation silo, which is precisely facing towards the under-
(Continued)

side of the end of the belt conveyer, a vibration trough is arranged at the lower part of the separation silo, a damper plate is disposed underside thereof, an air inlet is located underbelly thereof at the bottom of the separation silo, a rejection outlet is installed at the underside end of the vibrating trough.

9 Claims, 1 Drawing Sheet

(51) Int. Cl.

| | |
|---|---|
| ***B07B 9/00*** | (2006.01) |
| ***B07B 7/08*** | (2006.01) |
| ***B07B 7/01*** | (2006.01) |
| ***B07B 11/00*** | (2006.01) |

(58) Field of Classification Search
USPC ..... 209/21, 28, 29, 36, 37, 133, 138, 139.1
See application file for complete search history.

(56) References Cited

FOREIGN PATENT DOCUMENTS

| | | | |
|---|---|---|---|
| CN | 2922496 | Y | 7/2007 |
| CN | 101053868 | A | 10/2007 |
| CN | 201020451 | Y | 2/2008 |
| CN | 201454852 | U | 5/2010 |
| CN | 102626257 | A | 8/2012 |
| CN | 103143504 | A | 6/2013 |
| CN | 203108796 | U | 8/2013 |
| WO | WO9100697 | A1 | 1/1991 |

* cited by examiner

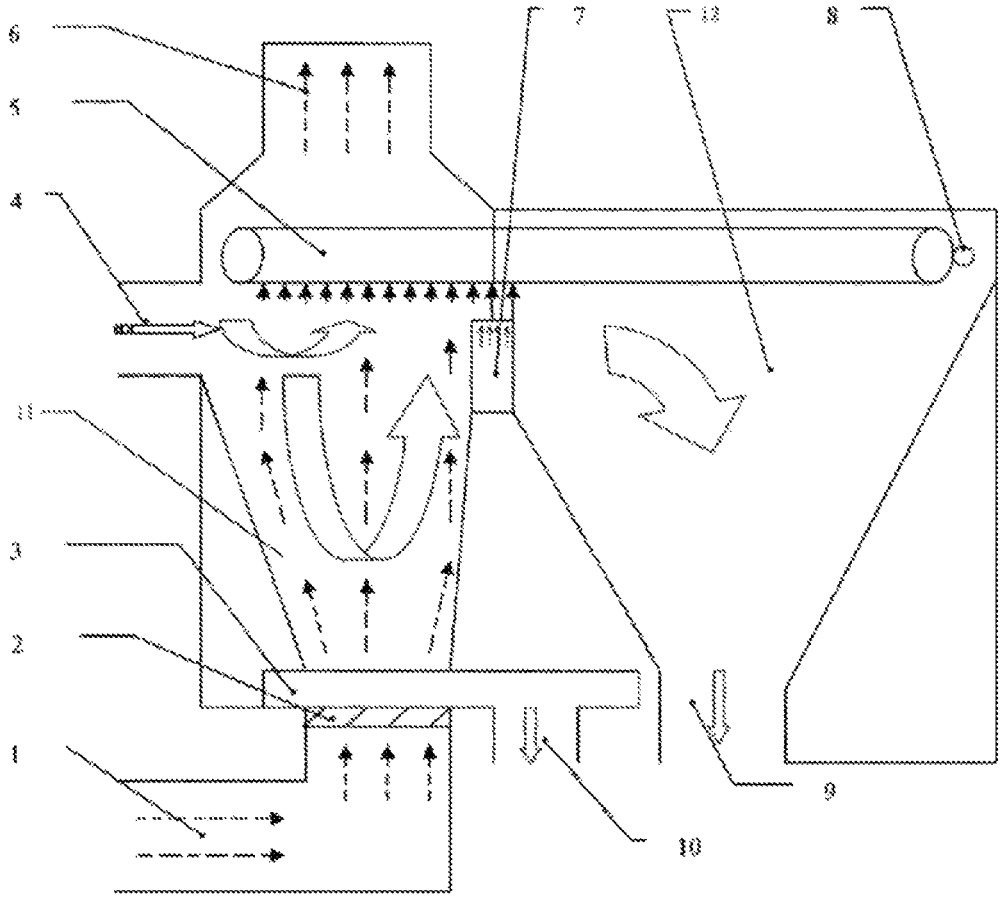
6
5
4
11
3
2
1
7
12
8
9
10

AIR-PRESSURE-TYPE DUAL-BIN AIR-POWERED SEPARATOR

TECHNICAL FIELD

The present invention relates to the technical art of pneumatic separating system, in particular to be applied in the tobacco manufacturing field, for use in the separation of the breakable materials.

BACKGROUND

Principle of pneumatic separation: The pneumatic separation defines the action of floating and separating certain material in an air flow. By setting a certain airflow velocity, it makes the lighter part of the materials, with the lower suspending speed than the set speed, move upwards, the heavier parts move otherwise downwards, so the materials are essentially separated into two parts of the lighter and the heavier. This principle is widely applied in various industries, such as CN201454852 U discloses a device for separating heavier high-qualified seeds.

CN 2922496 Y discloses a device for pneumatic separating invalid heavier stems and debris from cutting tobacco, in which the lighter and effective cutting tobacco is carried away, then is separated with the gas-materiel separation equipment after the pipeline transportation. CN 102626257 A and CN 2791087 Y disclose a device for use in separating mixed material such as tobacco slice and stem. The effective tobacco slice being separated is transported by air, is separated thereof then by use of the rotary discharge equipment. CN 101053868A discloses a device provided with binary silos for separating tobacco materials, wherein the different velocities are adopted in two silos result in twice separation of materials, the lighter and effective materials are carried away by air, then is separated with the gas-material separation equipment after the pipeline transmission.

It is indispensable for the lighter and effective materials to be sorted by using the devices mentioned above, the gas-material separation equipment after the pipeline transportation. The moisture of material should be reduced, the mechanical friction become more intense in the processes of transport and separation. As a result, it makes material size becoming smaller, and leads to production of large amounts of detritus, reducing use value for the material. Additionally, the devices above can simply implement the singular function of sorting, as for managing gas-material separation which is necessarily combined with other discharge equipment in addition, the correspondent equipment is complex and high energy consumption.

SUMMARY OF INVENTION

The purpose of the present invention is to solve the defects of the prior art, to provide a pneumatic separation apparatus with high efficiency, low energy consumption, simple structure, and low loss.

An apparatus for pneumatic separation disposed with binary silos described in the present invention is achieved by the following technical solutions.

The shared upper side wall of the separation silo is communicated with the discharge silo thereof through a communication port, where an air curtain is disposed to isolate both silos from each other. The discharge port is disposed at the bottom of the discharge silo. A suction outlet is mounted on the top of the separation silo, at the lower part of the side wall thereof is disposed a feeding port, which is precisely facing towards the end of the belt conveyer. At the lower part of the separation silo is arranged a vibration trough, under which is disposed a damper plat, underside of which has a air inlet just located at the bottom of the separation silo. A rejection outlet is installed beneath at the end of the vibrating trough.

The mesh belt conveyer is horizontally arranged in the separation silo and the discharge silo, compromising an air curtain taking the structure with a communication port, where an auxiliary air inlet is provided, on the top of which a series of air holes disposed, which is vertically facing the mesh belt conveyer.

The negative pressure at the suction outlet is 100-2100 Pa smaller than the standard atmospheric pressure, the pressure at mesh on the vibrating trough is 100-2000 Pa larger than the standard atmospheric pressure, the air inlet connected beneath the damper plate takes a rectangular bending structure, the airflow direction of the horizontal section of which is consistent with the transferring direction of the mesh belt conveyer, and the pressure in the discharge silo is equal to the standard atmospheric pressure.

The discharge silo has a trumpet shape of which upper part is bigger than lower part, tilt sidewalls of which are provided with angle regulators, a damper plate adopts pull chute, which is mounted beneath the mesh vibrating trough.

The mesh belt conveyer is equipped with corrective and tensioning devices.

The apparatus of claim 2 or 3, wherein at the end of the mesh belt conveyer, which is located in the discharge silo, is provided with a scratch brush.

By replacing the damper plate, which is located at the lower part of the separation silo, the positive pressure air flowing into the separation silo can be adjusted, and the air inlet is adopted with perpendicular angle bending structure, so that the pressure-balanced plane in the separation take forms with low pressure on the right, high on the left respectively.

The materials enter from the feed port to a separation silo on the belt conveyor or a vibrating trough in a way of horizontal throw, wherein the fine dust and detritus, whose size is less than dimension of the mesh hole on the belt conveyer, under the effect of negative pressure, infiltrate the mesh on belt conveyer and the suction outlet into the dust exhaust system; wherein the loose and lighter material, whose size is bigger than the mesh hole on the belt conveyer, is attached to the belt conveyer under the effect of negative pressure; wherein the remaining materials, floats in the air and is uplifted by wind force of the positive pressure, wherein the lighter material gradually are loosen and separated from the heavier material in the process of falling by being absorbed on the belt conveyer after being lifted to the pressure equilibrium plane, wherein the surplus materials falling on the vibrating trough located at the bottom, which are transformed by thereof, and further loosen under the joint effect with the forces of vibrating transmission and the positive airflow from underside, wherein the loose and lighter material is absorbed on the belt conveyer by negative pressure, after being lifted to the pressure equilibrium plane. The material absorbed underside of the belt conveyer falls by gravity into the discharge outlet with the normal standard atmospheric pressure outside, wherein the heavier is transported by a vibrating trough to its slot opening to be removed.

An auxiliary air inlet located between the separation silo and discharge silo, the uniformly distributed vents blowing off positive airflow, which takes the effect of isolating the pressures from each other so that the air pressure inside the discharge silo the same as the standard atmospheric pressure outside, which also uplift the materials continually on the first stage when the materials are transferred into the discharge silo, so that the material fall collectively to the middle of the discharge port, The material attached on the surface of mesh belt conveyer lost the negative pressure suction force and positive pressure lifting force from underside after entering into the discharge silo, separates itself with the mesh belt conveyer under its own gravity, and falls to the discharge outlet in a parabolic path, resulted by the inertia of mesh belt conveyer movement. A rotating brush mounted at the end of mesh belt, conveyer, which is tangential to thereof, make relative motion reversely against the mesh belt conveyer driving. The rotating brush brings down all the materials attached to the mesh belt conveyer, to the discharge outlet.

The present invention can achieve the material separation of different flow by adjusting the dimension of separation silo and the velocity of mesh belt conveyer, can separate the substance of different material by adjusting air pressure, wind speed.

The beneficial effects of the present invention include, achieving for multiple sorting materials in a single device, thereby enhancing the separation efficiency, so as to increase the processing capacity of equipment in the unit of width dimension, that the unit of width dimension of device in the direction of feeding can process larger flow of materials, so that the apparatus of the present invention, compared to other devices, can minimize the size thereof in the condition of handling the same flow of materials, and lessen the amount of wind so as to achieve the effect of reducing energy consumption.

The present invention avoids the particulate material from mechanical friction caused by the traditional separation equipment adopting the mechanism of air material separation and air lock discharge, eliminates size reduction and debris produced by the material crushing resulted by the mechanical friction, thereby improving the utilization of the material. The present invention is equally applicable to the technical field of pneumatic separating material, which the effective pa is heavier.

BRIEF DESCRIPTION OF DRAWINGS

FIG. 1 is a structure view of the present invention.

Legend: Air inlet 1; Damper plate 2; Mesh vibrating trough 3; Feeding port 4; Mesh belt conveyer 5; Suction outlet 6; Auxiliary air inlet 7; Scratch brush 8; Discharge port 9; Rejection outlet 10; Separation silo 11, Discharge silo 12.

DETAILED DESCRIPTION OF THE INVENTION

FIG. 1 is a construct view of a preferred embodiment of the present invention, consisting of a air inlet 1, a damper plate 2, a mesh vibrating trough 3, a feeding port 4, a mesh belt conveyer 5, a suction outlet 6, an auxiliary air inlet 7 a rotary scratch brush 8, a discharge outlet 9, a rejection outlet 10 a separation silo 11, and a discharge silo 12.

Operation process as shown, the material is transferred by vibrating conveyor from the feed port 4 (as fig.) into a separation silo 11 (as fig.), due to the inertia, makes the parabolic movement forward, during the moving process, wherein the fine dust and detritus, whose size is less than dimension of the mesh hole on the belt conveyer 5 (as fig.), infiltrate the mesh belt conveyer 5 (as fig.) into the dust exhaust system through the suction outlet 6 (as fig.); under the effect of negative pressure from the suction outlet 6 (as fig.), wherein a certain proportion of qualified material whose specific weight is light, is absorbed on the belt conveyer 5 (as fig.); wherein the remaining material, uplifted by wind of the positive pressure from air inlet 1 (as fig.), wherein the lighter material uplifted by positive pressure air is gradually separated from the heavier, and is absorbed on the belt conveyer 5 (as fig.) by passing through the pressure equilibrium plane of separation silo 11 (as fig.), wherein the remaining material falls on the vibrating trough 3 (as fig.), which are further loosen under the joint forces of vibrating transmission and the positive, so that wherein the lighter material is separated from the heavier once again, passes through the pressure equilibrium plane by uplifted by positive air, wherein the heavier material is transferred by the vibrating trough 3 (as fig.) and separated by falling to the rejection outlet 10, which is located on the underside thereof. The absorbed material on the belt conveyer 5 (as fig.) is taken into the discharge silo 12 (as fig.), due to the pressure in the discharge silo 12 (as fig.) same with outside atmospheric, therefore fall by gravity to the discharge port, the pneumatic separation is finally completed.

Preferred Embodiment: This embodiment is just in an example of illustration on tobacco pneumatic separation, which does not limit the scope of the present. invention. After a resurgence of tobacco, feeding, storing leaves, heating humidification, cutting, and drying, the cutting tobacco is transported into the separation silo 11 (as fig.) of the present invention as illustrated, due to the inertia, makes the parabolic movement downward, during the falling process, wherein the tine dust and tobacco debris, whose size is less than 1 mm (as the size of mesh hole on the belt conveyer 5 (as fig.)), with the effect of negative pressure, infiltrate the mesh belt conveyer 5 (as fig.) into the dust exhaust system through the suction outlet 6 (as fig.); under the effect of negative pressure above, wherein a certain proportion of qualified cutting tobacco whose specific weight is light, is absorbed on the belt conveyer 5 (as fig.); wherein the remaining material in the falling process, uplifted by wind of the positive pressure, wherein the lighter cutting tobacco is gradually separated from the heavier, passes through the pressure equilibrium plane of the separation silo ii (as fig.), and is absorbed on the belt conveyer 5 (as fig.) by, wherein the remaining cutting tobacco and stems fall on the vibrating trough 3 (as fig.), the mixture is further loosen under the joint forces of vibrating trough 3 (as fig.) and the positive pressure air, so that wherein the lighter cut tobacco is separated from the heavier stems once again, passes through the pressure equilibrium plane by uplifted by positive pressure air, is absorbed by negative pressure on the belt conveyer 5 (as fig.), wherein the heavier stems are transferred by the vibrating trough 3 (as fig.) and separated by falling to the rejection outlet 10. The absorbed cutting tobacco on the belt conveyer 5 (as fig.) is taken into the discharge silo 12 (as fig.), due to the pressure in the discharge silo 12 (as fig.) same with outside atmospheric, fall by gravity to the discharge port 9 (as fig.), which is transported by belt conveyer into the next process. The technical tasks of sorting, the stems out of the cutting tobacco are finally completed. Testing with the same batch of cutting tobacco is conducted to compare the subject invention with a traditional flexible air sorting device, the main technical indicators as the following:

| Test items | Cut rag processed by a flexible air sorting device | Cut rag processed by the present invention | Difference |
|---|---|---|---|
| Ratio of cut rag to stem (%) | 13 | 0.4 | 0.9 |
| Ratio of long cutting tobacco (%) | 60.4 | 62.1 | −1.7 |
| Ratio of medium size cutting tobacco (%) | 25.3 | 24.7 | 0.6 |
| Ratio of short cutting tobacco (%) | 13.6 | 12.9 | 0.7 |
| Ratio of detritus (%) | 0.7 | 0.3 | 0.4 |
| Moisture reduction (%) | 0.6 | 0.2 | 0.4 |

Test results indicate that the present invention has achieved the multiple separations of materials in a single device, has the advantages of low energy consumption, high efficiency, less material crushed, and less moisture loss.

The invention claimed is:

1. An apparatus for pneumatic separation, comprising:

a separation silo, comprising:

a first sidewall, a negative-pressure suction outlet disposed on the to of the separation silo, an air inlet disposed at the bottom of the separation silo, a vibration trough disposed in the separation silo and located above the air inlet, wherein the vibration trough has a rejection outlet installed at an underside end of the vibrating trough;

a damper plate is disposed below the vibration trough and above the air inlet, and a feeding port disposed at the first sidewall and located above the vibration trough and below the negative-pressure suction outlet;

a discharge silo, comprising:

a second sidewall communicated with the first sidewall through a communication port, and a discharge port is disposed at the bottom of the discharge silo, wherein the apparatus further comprises a mesh belt conveyor passing through the communication port from the separation silo into the discharge silo, the feeding port is located below the mesh belt conveyor, and wherein an air curtain is formed in the communication port to isolate the discharge silo and the separation silo from each other.

2. The apparatus for pneumatic separating in accordance with claim 1, wherein the mesh belt conveyer is horizontally arranged in the separation silo and the discharge silo, an auxiliary air inlet is provided under the communication port, a series of air holes are disposed on the auxiliary air inlet and vertically facing the mesh belt conveyer to form the air curtain.

3. The apparatus for pneumatic separating in accordance with claim 1, wherein a pressure at the negative-pressure suction outlet is 100-2100Pa lower than a standard atmospheric pressure, a pressure at a mesh on the vibrating trough is 100-2000Pa higher than the standard atmospheric pressure, the air inlet is connected to the bottom of the damper plate and has a rectangular bending structure, a airflow direction of a horizontal section of the air inlet is consistent with a transferring direction of the mesh belt conveyer, and a pressure in the discharge silo is equal to the standard atmospheric pressure.

4. The apparatus of claim 2, Wherein the discharge silo has a trumpet shape of which an upper part is bigger than a lower part, tilt sidewalls of the discharge silo are provided with angle regulators, the damper plate is mounted beneath the mesh vibrating trough by a pull chute.

5. The apparatus of claim 2, wherein the mesh belt conveyer is equipped with corrective and tensioning means.

6. The apparatus of claim 2, wherein an end of the mesh belt conveyer located in the discharge silo is provided with a scratch brush.

7. The apparatus of claim 3, wherein the discharge silo has a trumpet shape of which an upper part is bigger than a lower part, tilt sidewalls of the discharge silo are provided with angle regulators, the damper plate is mounted beneath the mesh vibrating trough by a pull chute.

8. The apparatus of claim 3, wherein the mesh belt conveyer is equipped with corrective and tensioning means.

9. The apparatus of claim 3, wherein an end of the mesh belt conveyer located in the discharge silo is provided with a scratch brush.

* * * * *